United States Patent [19]

Klee

[11] Patent Number: 4,528,819

[45] Date of Patent: Jul. 16, 1985

[54] EXHAUST CONTROL FOR CRYOGENIC FREEZER

[75] Inventor: David J. Klee, Emmaus, Pa.

[73] Assignee: Air Products and Chemicals, Inc., Allentown, Pa.

[21] Appl. No.: 608,058

[22] Filed: May 8, 1984

[51] Int. Cl.[3] ..... F25D 13/06

[52] U.S. Cl. ..... 62/63; 62/266; 62/374; 62/380; 236/49

[58] Field of Search ..... 62/63, 266, 374, 375, 62/380; 236/49

[56] References Cited

U.S. PATENT DOCUMENTS

| | | | |
|---|---|---|---|
| Re. 28,712 | 2/1976 | Klee | 62/65 |
| 3,214,928 | 11/1965 | Oberdorfer | 62/374 |
| 3,299,659 | 1/1967 | Dreksler et al. | 62/380 |
| 3,345,828 | 10/1967 | Klee et al. | 62/63 |
| 3,403,527 | 10/1968 | Berreth et al. | 62/266 |
| 3,485,055 | 12/1969 | Webster et al. | 62/63 |
| 3,826,100 | 7/1974 | Vahl | 62/375 |
| 3,892,104 | 4/1975 | Klee et al. | 62/374 |
| 3,898,863 | 8/1975 | Wagner | 62/374 |
| 3,926,080 | 12/1975 | Bettcher | 83/15 |
| 3,927,828 | 12/1975 | Jones | 236/49 |
| 4,057,978 | 11/1977 | Sato et al. | 62/374 |
| 4,276,753 | 7/1981 | Sandberg et al. | 62/380 |
| 4,394,957 | 7/1983 | Newton, III | 236/49 |

*Primary Examiner*—Ronald C. Capossela

*Attorney, Agent, or Firm*—Geoffrey L. Chase; E. Eugene Innis; James C. Simmons

[57] ABSTRACT

An exhaust system for a cryogenic freezer is set forth wherein the system senses the temperature of an aperture in the freezer to detect any outward passage of cryogenic vapors and based upon that sensing, controllably operates an exhaust fan to remove such cryogenic vapors.

6 Claims, 1 Drawing Figure

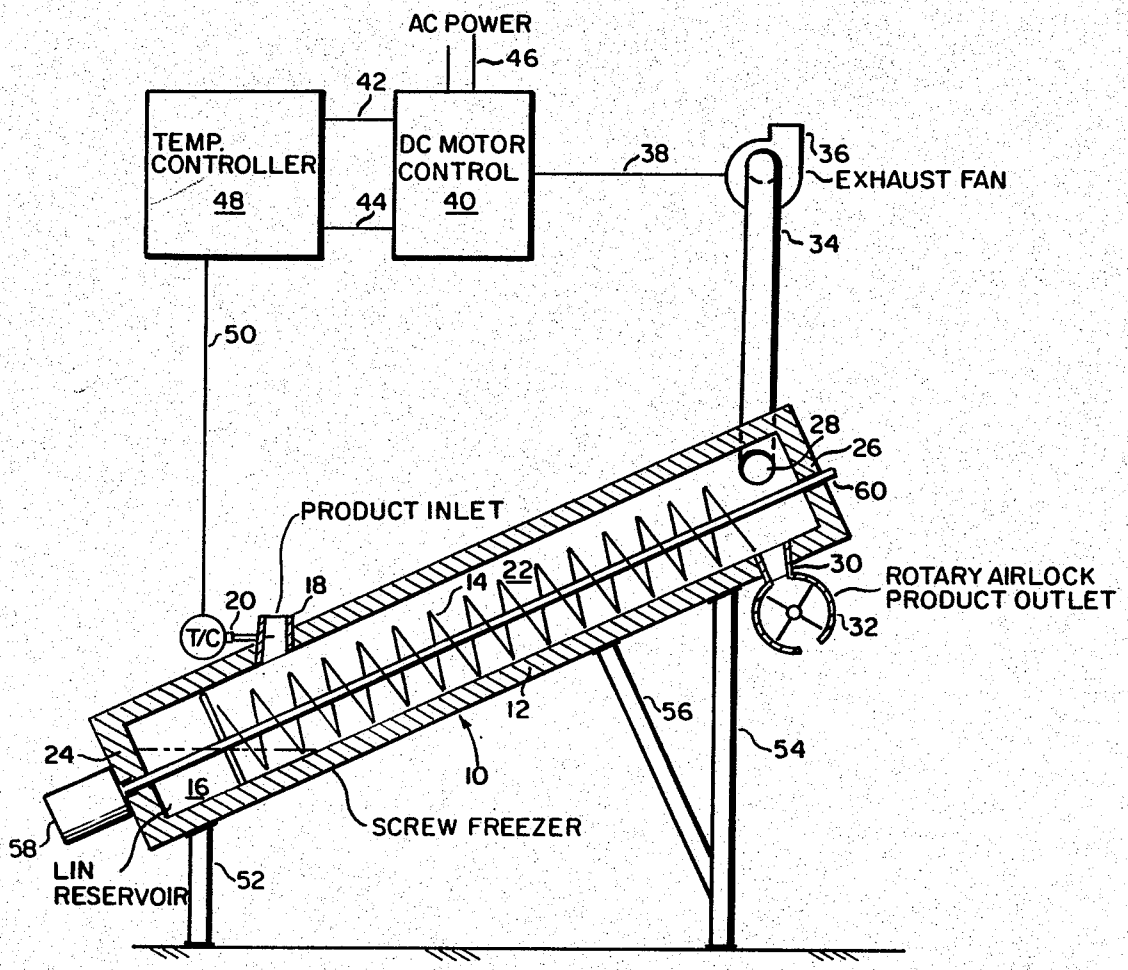
AC POWER
46
DC MOTOR CONTROL
40
42
44
TEMP. CONTROLLER
48
50
38
36
EXHAUST FAN
34
28
26
60
PRODUCT INLET
ROTARY AIRLOCK PRODUCT OUTLET
30
32
54
56
22
14
12
10
SCREW FREEZER
18
20
T/C
16
52
24
58
LIN RESERVOIR

EXHAUST CONTROL FOR CRYOGENIC FREEZER

TECHNICAL FIELD

The present invention is directed to freezers for the cryogenic freezing of particulate materials in a bath of cryogenic fluid. More specifically, the invention is directed to an improved exhaust control system for cryogenic freezers using a liquid cryogen which is vaporized upon absorbing the heat from the particulate material to be frozen.

BACKGROUND OF THE PRIOR ART

Various means of freezing particulate materials have been known and utilized in the refrigeration industry. Typical refrigerated freezers using mechanical refrigeration operated on fluorcarbon refrigerants have been used for what is termed normal slow freezing of particulate materials, such as foodstuffs. Mechanically refrigerated freezers typically have the drawback that temperatures are not sufficiently low, such that delicate foodstuffs, having a significant water content, are frozen in a well preserved structural manner wherein structural membranes remain intact. Additionally, such mechanically refrigerated freezers tend to allow the particulate materials to agglomerate during the freezing process due to surface moisture which is frozen on the individual particles.

Subsequently, various cryogenic freezers have been designed and utilized by the industry, wherein the cryogenic freezers utilize cryogenic fluids to directly impart the refrigeration value to the particulate material to be frozen. Typical cryogenic fluids include liquid nitrogen, liquid carbon dioxide, liquid air and various inert halogenated hydrocarbons. In a cryogenic freezer, the cryogenic fluid directly contacts the particulate materials to be frozen, which is in contrast to mechanical refrigerated freezers wherein a liquid cryogen may be utilized as a heat transfer media, but is maintained in a separate distinct circuit with only indirect heat exchange with the product to be frozen.

In the known cryogenic freezers, the particulate material to be frozen is typically immersed in the cryogenic liquid and is rapidly frozen so as to avoid destruction of any structure or membranes of the particulate material and to avoid the agglomeration of individual particles of the material to be frozen. However, during the course of the introduction of relatively warm particulate materials into the bath of cryogenic liquid, the heat removed from the particulate materials is imparted to the cryogenic liquid with the subsequent vaporization of liquid to a cryogenic vapor. This vapor is not without value. Most cryogenic freezers utilize this still significantly cold cryogenic vapor for additional freezing duty by direct contact of the vapor with incoming particulate material as a precooling step or with subsequent contact of the immersed initially frozen material with cryogenic vapors to further reduce the temperature of the particulate material. However, the production of cryogenic vapor is not without drawbacks. Typically, the cryogenic vapor, if it is not produced from liquified air, constitutes a health hazard to personnel working around the cryogenic freezer. In light of the necessity for apertures into and out of the freezer so as to introduce particulate material for freezing and removing frozen particulate material as product, the cryogenic vapors produced during freezing operations are usually capable of escaping into the adjacent space around the freezer where potentially adverse effects of the vapors would be experienced by operating personnel. Where the cryogenic vapor is nitrogen or carbon dioxide, any sizable amount of cryogenic vapor escaping into the atmosphere surrounding the freezer would create a potential for asphyxiation of operating personnel.

It has been known to remove such excess cryogenic vapors by various ducting and exhaust techniques. In U.S. Pat. No. 3,345,828 and U.S. Pat. No. Re. 28,712, a system is disclosed wherein a thermocouple 39 located near one end of a conveyor belt senses temperature produced by the cooling cryogenic vapor and provides an input into an automatically operated blade 76 at the end of the cryogenic freezer. The blade controls the amount of cryogenic vapor that exits the freezer, such that sufficient vapor remains in the freezer inner space so as to maintain a cold vapor bath commensurate with the location of the thermocouple. Cryogenic vapor which exits along stream E passed the blade 76 is removed from the space adjacent the freezer by conduit 51 exhaust fan 52 and additional conduit 54. Therefore, in these patents, the depth of cryogenic vapor is sensed and a blade which controls the exit of gas to the space outside the freezer is adjusted to control that exiting flow; which flow is then subsequently intercepted by an exhaust system which is not controlled by the thermocouple or by the temperature sensing means within the freezer itself.

In U.S. Pat. No. 3,403,527, a cryogenic vapor freezer utilizing a conveyor belt is set forth wherein any escaping cryogenic vapors are removed by exhaust collector 43 and conduit 45 powered by an exhaust fan. Control of the exhaust rate based upon freezer conditions is not set forth.

In U.S. Pat. No. 3,892,104, a cryogenic freezer utilizing cryogenic vapor as a cooling medium provides for pressure sensing in the supply line of cryogenic liquid to be vaporized in the freezer for the basis of a signal to control internal circulation fans 74, such that circulation of cryogenic vapor within the freezer is commensurate with liquid flow to a spray header 35.

Finally in U.S. Pat. No. 3,926,080 an immersion cryogenic freezer is set forth wherein foodstuffs are conveyed through a bath for surface freezing prior to further processing of the foodstuff in downstream sectioning and cutting apparatus. No control of cryogenic vapor dispersal is set forth.

The prior art has suggested various methods for control of vapors emanating from a cryogenic freezer. However, none of the prior art suggests a mode for controllably removing cryogenic vapors from a cryogenic freezer, nor do they provide for termination of the exhaust mode if an influx of ambient outside air occurs into the freezer. Additionally, the direct automatic control of an exhaust fan as in the present invention provides for a linear increase in gas flow commensurate with the fan speed related to the electrical output of the sensing means. This is in contrast with the nonlinear gas flow commensurate with an altering damper position as recited in U.S. Pat. No. 3,345,828. Finally, the prior art typically does not have automatic control of the exhaust fan associated with the respective cryogenic freezers, but rather requires the exhaust fan to be manually operated, or operated continuously.

The attributes of the present invention will be more fully appreciated from the disclosure which follows.

BRIEF SUMMARY OF THE INVENTION

The present invention is directed to an improvement in a cryogenic freezer for freezing particulate material by contact with a cryogenic fluid wherein the freezer has a conveying means within an insulated freezer passageway, a first aperture for introducing particulate material into the freezer and to the conveying means and a second aperture for moving frozen product from the freezer and the conveying means, in which the product is contacted with the liquid phase of the cryogenic fluid and is further contacted with the vapor from said cryogenic fluid, wherein the improvement comprises a cryogenic vapor exhaust system comprising an exhaust conveying means for moving cryogenic vapors from said freezer and an exhaust control monitor for sensing the temperature at one of the apertures of the freezer and providing a signal to the exhaust conveying means to remove cryogenic vapor when the temperature drops below a set value.

Preferably the freezer has a liquid bath of cryogen in which the product is initially immersed for freezing.

Preferably the sensing of temperature is performed at the lowermost aperture of the freezer.

Preferably the exhaust conveying means is a variable speed centrifugal exhaust fan and appropriate conduits for removing cryogenic vapors from the freezer to an external location distant from the area adjacent the freezer where personnel may be in attendance.

Preferably the freezer includes an exhaust control monitor which constitutes a thermocouple located at the lowermost aperture of the freezer and a variable output electrical signal converter connected to the exhaust fan so as to provide an electrical input to the exhaust fan to vary its speed and the exhausting of cryogenic vapor dependent upon the temperature sensed by the thermocouple at the lowermost aperture of the freezer.

Optimally, the cryogenic vapor exhaust system is used with a screw auger-assisted cryogenic freezer wherein the auger constitutes the conveying means and is situated in an inclined plane so as to convey the particulate material to be frozen through a bath of cryogenic liquid at the low end of the freezer upwardly through cryogenic vapors emanating from the liquid to an elevated position wherein the frozen particulate material may be removed for subsequent handling.

Additionally, the invention includes a process for controlling the removal of cryogenic vapors from a cryogenic fluid freezer having at least a first lowermost aperture, wherein the improvement comprises sensing the temperature of the gas at the aperture, comparing the sensed temperature to a predetermined set value, generating a variable magnitude electrical input to an exhaust fan connected to the freezer and exhausting cryogenic vapors at a rate commensurate with the difference between the sensed temperature and the preset value.

Although the invention is preferably used with a screw-auger freezer, it can alternately also be used with a freezer as described in U S. Pat. No. 3,892,104.

BRIEF DESCRIPTION OF THE DRAWING

The drawing represents a schematic portrayal of the exhaust system of the present invention in its preferred embodiment.

DETAILED DESCRIPTION OF THE INVENTION

The cryogenic vapor exhaust system of the present invention will be described in greater detail with respect to the above-identified drawing. This preferred embodiment is set forth in conjunction with a screw auger-assisted cryogenic freezer. However, it will be appreciated by those skilled in the art that the temperature actuated exhaust system may be utilized with other cryogenic freezers whether they operate with cryogenic liquids or cryogenic vapors and whether they operate with screw augers as conveying means or with conveyor belts such as disclosed in the prior art. Therefore, U.S. Pat. Nos. 3,345,828; 3,403,527; 3,892,104; and U.S. Pat. No. Re. 28,712 are hereby incorporated by reference to the extent that they disclose relevant cryogenic freezers which may be incorporated with the cryogenic vapor exhaust system of the present invention.

With reference to the drawing the present invention will now be further described. A cryogenic fluid screw operated freezer 10 such as set forth in U.S. application Ser. No. 546,678 filed Oct. 28, 1983, incorporated herein by reference, is operated preferably with a cryogenic liquid constituting liquified nitrogen. Alternately other cryogenic fluids may be utilized such as liquid air, liquid $CO_2$, liquid fluorocarbons and other inert media which are liquid at low temperature and vaporize at temperatures well below ambient conditions. The liquid nitrogen is supplied from any reasonable source and is allowed to pool 16 in the base of the inclined screw freezer 10 to form an immersion bath. The freezer is fabricated of any reasonable materials, such as stainless steel, and constitutes an outer jacket 12, which is preferably insulated, but does not necessarily have to be insulated depending upon the conditions dictating the efficiency of operation. The walls 12 form a passageway 22, which is preferably in this embodiment a generally cylindrical tunnel, which is closed by a lowermost end wall 24 and an uppermost end wall 26. The freezer is supported by various legs 52, 54 and 56 so as to be inclined such that the liquid nitrogen is allowed to pool at the lower end and cryogenic vapors rise and collect further up the tunnel or passageway 22 of the freezer 10. The cryogenic vapors do not inherently rise to the uppermost point 26 of the freezer due to the dense nature of the vapors, but will flow out of the nearest aperture in this case the lowermost aperture 18. The screw auger 14 is driven by motor 58 on axle 60 such that particulate material may be advanced from the cryogenic liquid pool 16 to the upper region near end 26 of the freezer 10.

Particulate materials such as foodstuffs, including diced carrots, peas, shrimp, as well as other particulate non-foodstuff materials may be processed in the freezer. The particulate material is introduced into the freezer 10 through a first aperture 18 which constitutes a product inlet, which communicates with the interior 22 of the freezer. The aperture 18 is located near the lowermost end 24 of the freezer such that the particulate material introduced into the freezer descends into a pool or bath 16 of cryogenic liquid, in this case liquid nitrogen. The materials immersed in the liquid cryogen are rapidly frozen and continue to cool as the screw auger 14 on axle 60 driven by motor 58 slowly conveys the material out of the bath of liquid cryogen 16 and ascends the freezer 10 toward the uppermost end 26. As the material is conveyed, it is further chilled by cryogenic vapor, which is boiling from the cryogenic liquid due to the heat imparted to the liquid from the particulate material being fed to the freezer 10. The frozen particulate material is eventually conveyed to a second aperture 30 at the uppermost end 26 of the freezer 10. It is then removed from the freezer through a rotary airlock 32 which constitutes a product outlet. The airlock prevents the egress of any substantial amount of cryogenic vapor or the ingress of any substantial amount of air during the discharge of frozen material.

During the course of the introduction of particulate material to be chilled or frozen into the freezer 10, a quantity of cryogenic vapor is produced from the liquid bath of cryogenic fluid 16 in the freezer 10. Depending upon the temperature of the added particulate material and the rate of its introduction, a quantity of cryogenic vapor is produced such that at some point in the operation, cryogenic vapor may emanate out of the lowermost aperture 18 into the surrounding space where the freezer 10 is located. This result is detrimental because it allows valuable cryogenic vapor, which has the capability of providing cooling to the particulate material subsequent to its being immersed in the liquid cryogen, to be lost. The emanating cryogenic vapors from the aperture 18 pose the potential for detrimental health effects to any operating personnel in the vicinity of the freezer. Specifically, with regard to nitrogen and carbon dioxide, any notable increase in the content of those cryogenic vapors in the atmosphere adjacent the freezer would pose the potential for asphyxiation of personnel. Therefore, it is necessary to detect the presence of cryogenic vapor at this aperture and to control its circulation within the freezer and potentially through any aperture from which it may emanate.

Although it would appear that merely exhausting the vapor at some continuous rate would solve the problem, in actual practice such a solution would not be a practical or economic remedy. If an exhaust fan, such as the fan 36 set forth in the drawing, were operated at a continual rate, and this rate exceeded the evolution of vapor from the liquid bath 16, humid air would be effectively sucked in through an aperture. This would diminish the refrigerating potential of the freezer, as well as introduce moisture into the system which would readily freeze and begin to clog various surfaces of the freezer most notably in this preferred embodiment the product inlet which constitutes the first aperture 18.

In order to overcome this problem, the present invention utilizes a cryogenic vapor exhaust system which constitutes an additional aperture 28 at the uppermost end 26 of the freezer 10. This aperture is connected to a conduit 34 which provides communication between the freezer 10 and an exhaust fan 36 which is preferably a centrifugal exhaust fan capable of variable speeds dependent upon the DC voltage input to the fan. Although not shown, the fan would exhaust to a distant location, preferably the exterior of the building housing the freezer 10 so that the opportunity for detrimental health effect or asphyxiation is not posed. In order to operate the fan so that only the excess cryogenic vapor produced from the liquid bath 16 is removed, the fan is controlled by a unique sensing means which constitutes an exhaust control monitor.

The exhaust control monitor senses the temperature at the first aperture 18 and relays this signal to electrical conversion equipment which then conveys a proportional DC electrical power output to the exhaust fan to control the fan with relationship to the sensed temperature. The exhaust control monitor constitutes a thermocouple 20 situated in the aperture 18 which constitutes the product inlet. As excess cryogenic vapor begins to emanate out of the aperture 18, the temperature in that vicinity drops due to the low temperature of the cryogenic vapor. This temperature is sensed by the thermocouple 20 and a small millivolt electrical signal is conveyed through line 50 to a temperature controller 48. The temperature controller receives the input from the thermocouple and compares it against a set value preprogramed in the controller. The controller 48 further calibrates the magnitude of the difference between the set value and the reading provided by the thermocouple and generates a proportional voltage which is supplied through circuit lines 44 and 42 to a DC motor control. Although the temperature controller may be any variable output electronic device which achieves the stated objective, the unit would preferably be analogous to one preferred model, namely; the Barber Colman 560 Series Digital Set-Point Controller, Model 5645.

The signal from the temperature controller 48 is received by the DC motor control 40 which also can ascertain the magnitude of the DC input to the control 40 and then provides a proportional DC electrical output in line 38 provided from converted power from a conventional AC power input 46. The variable voltage DC output in line 38 controls the fan speed of the exhaust fan 36.

Therefore, by sensing the temperature at the product inlet 18 with the thermocouple 20 and converting this reading to a proportional electrical output, the exhaust fan may be operated at the particular speed necessary to exhaust excess cryogenic vapors dependent upon the temperature sensed in the product inlet 18. The system operates very precisely due to the linear increase in gas flow through the centrifugal exhaust fan with corresponding increase in fan speed. In addition, calibration is not necessary because the system is constantly sensitive to and receives input from the thermocouple. When excess cryogenic vapors are not present due to: sufficient exhausting, reduced vaporization or less product input through aperture 18, then the cryogenic vapors will not emanate out through the aperture 18, and potentially, outside air may tend to settle in the aperture 18. This air influx would be sensed by the thermocouple and the relatively warm temperature of the air would provide a reading which would effectively deactivate the exhaust fan so that air with its moisture content would not be pulled into the freezer with resulting frost buildup.

The DC motor control 40 may constitute any mechanism that will achieve the objectives of receiving a relatively small DC voltage and providing a proportionally larger output voltage sufficient to run the exhaust fan 36. However, preferably the DC motor control 40 would constitute a unit similar to the preferred control device, namely; a PolySpede Electronics OC2-300 SCR DC Motor Control Unit.

The present invention provides a safe and economic exhaust means for cryogenic freezers using a cryogenic liquid media for the production of low temperature. The present invention allows cryogenic vapors to remain in the freezer under all circumstances short of egress of the vapors out to the space surrounding the freezer where they may be detrimental to personnel and constitute an uneconomical loss of refrigeration value. This results in only the removal of the quantity of vapor which would constitute excess vapor from the freezer. In addition, by variably and automatically controlling vapor removal, the system prevents the introduction of potentially warm moist air into the freezer, which would cause both an elevation in freezer temperature, as well as a significant problem with frost build-up in the freezer internal workings. The system uniquely avoids calibration problems and any reliance upon the flow of cryogenic liquid into the freezer. Therefore, the automatic control provided by the invention wherein sensing occurs directly at the vicinity of the freezer where cryogenic vapors or external atmospheres would create less than optimal operation provides a unique solution to the problems of the economic and safe operation of cryogenic freezer equipment.

The present invention has been set forth with regard to a specific preferred embodiment, but those skilled in the art will recognize obvious variations from this disclosure. For instance, the exhaust control could easily be used on a conveyor belt operated, spray freezer as described in U.S. Pat. No. 3,892,104 wherein temperature sensing would be performed at the aperture closest to the spray header. Therefore the scope of the invention should not be ascertained from this specific embodiment, but rather from the claims which follow.

I claim:

1. In a cryogenic freezer for freezing a product by contact with a cryogenic fluid, having; an insulated freezer passageway, a conveying means within said insulated freezer passageway, a first lowermost aperture for introducing product into the freezer and to the conveyor means and a second and upper aperture for removing frozen product from the freezer and the conveyor means, wherein the product is contacted by the liquid phase bath of the cryogenic fluid and is further contacted with the vapor from said cryogenic fluid, the improvement comprising a cryogenic vapor exhaust system comprising an exhaust conveying means for removing cryogenic vapors from said freezer and an exhaust control monitor for sensing the temperature in said first lowermost aperture of the freezer and providing a proportional signal to the exhaust conveying means to remove vapor when the temperature drops below a set value so that only the excess cryogenic vapor produced in the freezer is removed and the exhaust mode is terminated before an influx of outside air occurs into the freezer.

2. The freezer of claim 1 wherein the exhaust conveying means constitutes a variable speed fan and appropriate conduits for removal of cryogenic vapors to distant location.

3. The freezer of claim 1 wherein the exhaust control monitor constitutes a thermocouple located at the lowermost aperture of the freezer and a variable output electric signal converter connected to the exhaust fan.

4. The freezer of claim 1 wherein the conveying means is a screw auger situated at an inclined angle wherein the input end of the auger is at the lowermost point of the freezer adjacent the first aperture and is at least partially immersed in cryogenic liquid, while the discharge end is at the uppermost end of the freezer adjacent the second aperture.

5. The freezer of claim 1 wherein the second aperture constitutes a rotary airlock.

6. In a process for controlling the removal of cryogenic vapors from a cryogenic fluid freezer having a first lowermost aperture for introducing product into freezer, an insulated freezer passageway, conveying means within said passageway, a second upper aperture for removing product from the freezer and a liquid bath of cryogenic fluid wherein the product is immersed in the bath and conveyed through the cryogenic vapors to the second aperture to freeze the product, comparing the sensed temperature to a predetermined set value and generating a variable magnitude electrical input to an exhaust fan connected to the freezer and exhausting cryogenic vapors at a rate commensurate with the difference between the sensed temperature and the preset value so that only the excess cryogenic vapor produced in the freezer is removed and the exhaust mode is terminated before an influx of outside air occurs into the freezer.

* * * * *